US006298814B1

(12) United States Patent
Pearlman et al.

(10) Patent No.: US 6,298,814 B1
(45) Date of Patent: Oct. 9, 2001

(54) SECTIONALIZED ROCKER ARM COVER ASSEMBLY

(75) Inventors: Samuel Pearlman, West Bloomfield; Jared Keyes, Madison Heights, both of MI (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 09/756,633

(22) Filed: Nov. 27, 2000

(51) Int. Cl.[7] ..... F01M 9/10; F02F 7/00

(52) U.S. Cl. ..... 123/90.38; 123/195 C; 123/198 E; 123/193.5; 123/470

(58) Field of Search ..... 123/90.38, 193.5, 123/195 C, 198 E, 470

(56) References Cited

U.S. PATENT DOCUMENTS 4,757,789 * 7/1988 Laine ..... 123/193.5
5,511,520 * 4/1996 Regueiro ..... 123/193.5
5,699,770 * 12/1997 Matsumoto et al. ..... 123/470
5,896,837 * 4/1999 Nysten et al. ..... 123/90.38

* cited by examiner

*Primary Examiner*—Weilun Lo
(74) *Attorney, Agent, or Firm*—Bill C. Panagos

(57) ABSTRACT

A sectionalized rocker arm cover assembly (10) is utilized for diesel engine (14) applications having overhead high pressure fuel lines (26). The fuel lines (26) connect to fuel injectors (20) that protrude through a primary member (16) of the rocker arm cover assembly (10). The rocker arm cover assembly (10) is sectionalized longitudinally. Sectionalizing the cover assembly (10) obviates the need to dismantle the fuel lines (26) and permits easy access to service the rocker arms (29). The injectors (20) are disposed longitudinally and provide vertical support to the rocker arm cover assembly (10).

18 Claims, 4 Drawing Sheets

SECTIONALIZED ROCKER ARM COVER ASSEMBLY

TECHNICAL FIELD

This invention relates to a combustion engine rocker arm cover assembly and more particularly to a sectionalized rocker arm cover assembly with protruding fuel injectors.

BACKGROUND OF THE INVENTION

Rocker arm covers are commonly utilized for combustion engine applications. The covers arc engaged sealably over a cylinder head of a combustion engine thereby protecting a series of rocker arms. The covers not only protect the rocker arms, but assure that oil, which sprays about and lubricates the rocker arms and surrounding mechanisms, remains within the engine cylinder head. The rocker arm cover typically is of a one piece construction having a resilient seal placed between the engine cylinder head and the rocker arm cover.

The high-pressure fuel injection system of a diesel combustion engine has a unique configuration compared to that of a gasoline engine. The high-pressure fuel injectors are commonly placed above and parallel to each combustion cylinder and can be accessed after removal of the rocker arm cover. The fuel injectors are fed by high-pressure fuel lines which penetrate a side of the engine cylinder head and engage the fuel injectors perpendicularly at mid-length. This engagement produces numerous problems. First, unwanted lateral stresses are placed upon the injectors which hinder reliability of radially extending injector seals. Second, fuel leakage at the injector connection is not easily detectable. Any leaking fuel can mix with the lubricating oil thereby compounding problems with engine operation.

To resolve these concerns, current interest is to extend the diesel fuel injectors up through the rocker arm cover. Fuel can then be fed to the injectors from a protruding injector end disposed above the rocker arm cover. The high-pressure fuel line connection to the injector is more reliable than the mid-length connection. And, any chance occurrence of fuel leakage is isolated from the engine oil and is easily detectable. Unfortunately, the high-pressure fuel lines must extend over the rocker arm cover to feed the fuel injectors. In order to service the rocker arms or mechanisms beneath the rocker arm cover, the high-pressure fuel lines must be dismantled prior to removing the rocker arm cover.

SUMMARY OF THE INVENTION

The invention provides a sectionalized rocker arm cover assembly having a primary member, a secondary member, a plurality of fuel injectors and a plurality of respective high pressure fuel feed lines. The primary member has a primary brim sealingly connectable to a cylinder head of a combustion engine. Each fuel injector protrudes through an orifice of the primary member. The orifices align longitudinally along the primary member length. Substantially extending longitudinally along the primary member is a primary edge. The primary edge engages sealably to a secondary edge of the secondary member. The secondary member also has a secondary brim sealingly connectable to the cylinder head of the diesel engine. A plurality of high pressure fuel lines extend over the secondary member and connect to a fuel feed end of each fuel injector disposed above the primary member.

Preferably, each orifice of the primary member is defined by an upper edge, a lower edge, and an intermediate surface.

The intermediate surface interposes and is defined by the upper and lower edges. Each fuel injector preferably has an extension portion attached beneath the fuel feed end. The extension portion has a shelf facing upward. The cross sectional area of the fuel feed end is smaller than the cross sectional area of the extension portion, the difference amounting to the surface area of the shelf. The shelf contacts the intermediate surface surrounding the primary member orifice. This contact provides vertical support to the primary member thereby providing a reliable seal along the primary and secondary edge of the respective primary and secondary members without the addition of further fasteners. Adequate clearance is provided between the secondary member and the rocker arm mechanisms so that the secondary member can disengage and slide out from beneath the assembled high pressure fuel lines for maintenance of the rocker arms.

Thus, an advantage of the present invention is a reliable seal along the primary and secondary edges.

Another advantage of the present invention is facilitating access below the rocker arm cover without having to dismantle the fuel injection system.

BRIEF DESCRIPTION OF THE DRAWINGS

Reference is now made to the accompanying drawings, in which.

DETAILED DESCRIPTION OF THE PREFERRED EMBODIMENT

Figure 1:
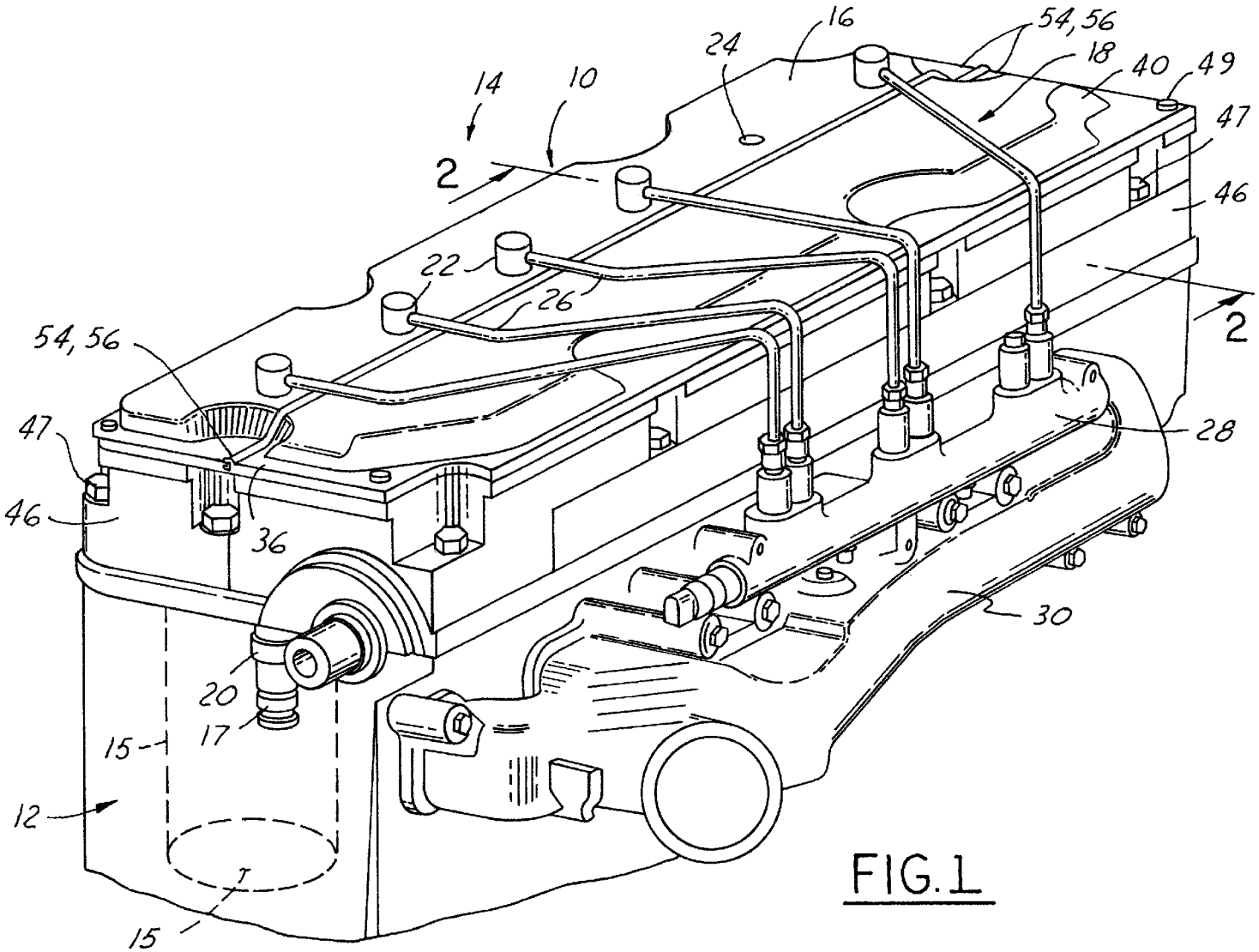
FIG. 1 is a partial perspective view of a combustion engine having a sectionalized rocker arm cover assembly in accordance with the invention.

Referring now to FIG. 1 of the drawings, a sectionalized rocker arm cover assembly 10 interconnects to a cylinder head 12 of a combustion engine 14 having cylinders 15, generally from above. The interconnections of the rocker arm cover assembly 10 seal to prevent engine oil leakage and to attenuate engine noise. A primary member 16 connects longitudinally to a secondary member 18 of the sectionalized rocker arm cover assembly 10.

A plurality of fuel injectors 20 is substantially disposed perpendicularly beneath the primary member 16 of the rocker arm cover assembly 10. Each fuel injector 20 has a lower end 17 and an upper fuel feed end 22. Each lower end 17 protrudes into the respective cylinder 15 from above, and each fuel feed end 22 protrudes through a respective orifice 24 of the primary member 16 from below. The plurality of orifices 24 generally align along the primary member 16 longitude. Each fuel feed end 22 connects to a high pressure fuel line 26 which routes over the secondary member 18 to a fuel manifold 28 generally located beneath the rocker arm cover assembly 10 and along the combustion engine 14 side. Preferably, fuel manifold 28 is above, as opposed to below, an air-intake manifold 30. Placement of the fuel manifold 28 is away from, or opposite, the hot exhaust manifold of the combustion engine 14 to prevent premature heating of the fuel. The secondary member 18 is sufficiently shallow wherein secondary member 18 can slide out from beneath the fuel feed lines 26 after disengagement from the combustion engine 14 without having to disassemble the high pressure fuel system.

Figure 2:
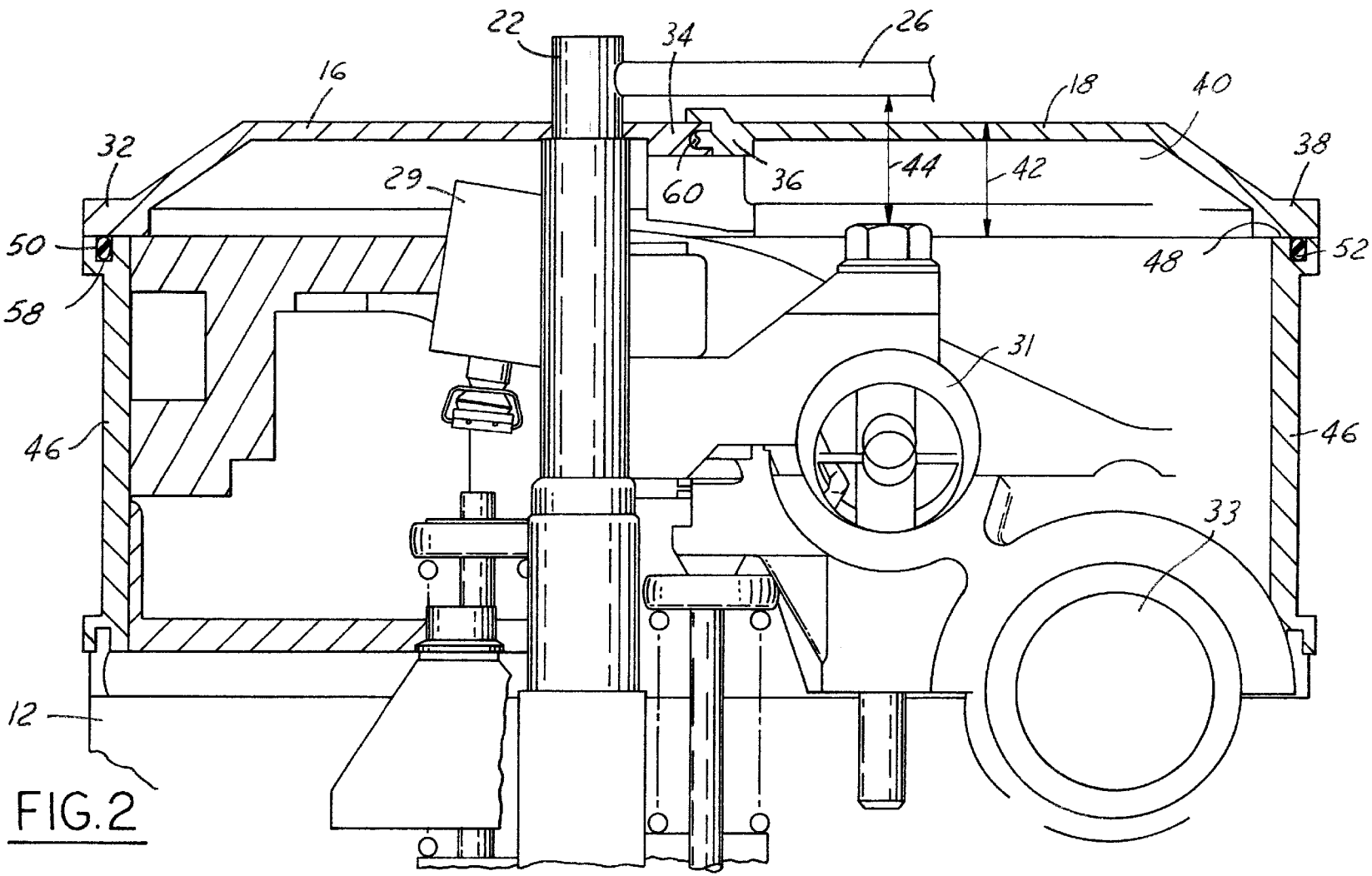
FIG. 2 is a cross-sectional view of the sectionalized rocker arm cover assembly taken along line 2—2 as shown in FIG. 1.

Referring to FIG. 2, the secondary member 18 is generally disposed above a series of rocker arms 29 and associated rocker arm shaft 31, and cam 33. A primary brim 32 of primary member 16 interconnects to cylinder head 12. A primary edge 34 of primary member 16 engages a secondary edge 36 of the secondary member 18. A secondary brim 38 of secondary member 18 interconnects to the cylinder head 12. In assembly, the primary brim 26 is substantially planar to the secondary brim 32. The secondary brim 38 has a trailing end portion 40 as shown in FIG. 1 which may or may not be planar to the primary brim 32. The restriction is that a lineal distance 42, generally measuring from the trailing end portion 40 bottom to the secondary member 18 top, must be substantially less than a lineal distance 44, generally measuring vertically from the fuel feed lines 26 bottom to the highest combustion engine 14 projection disposed beneath the secondary member 18.

Preferably, primary brim 32, secondary brim 38, and trailing end portion 40 of the secondary brim 38 are all planar to one-another for ease of manufacturing and assembly. To assure lineal distance 42 is substantially less than lineal distance 44, the sectionalized rocker arm cover 10 has a shoulder 46 interposing beneath the primary and secondary members 16, 18, and above the cylinder head 12. The shoulder 46 periphery generally aligns beneath the primary and secondary brims 32, 28. The shoulder 46 height is substantially parallel to fuel injectors 20 and serves to reduce the lineal distance 42 to the required clearance amount. Shoulder 46 is secured to the cylinder head 12 via a plurality of standard threaded fasteners 47. The primary and secondary members 16, 18 are connected to the shoulder 46 via a plurality of standard threaded fasteners 49 as shown in FIG. 1.

With the presence of shoulder 46, the primary and secondary brims 32, 38 each have respective two-ends 54, 56. Wherein, the two ends 54 of the primary brim 32 engage to the two ends 56 of the secondary brim 38 as shown in FIG. 1. The primary edge 34 extends between the two ends 54 and the secondary edge 34 extends between the two ends 56 of the secondary member 18. A top surface 48 of shoulder 46 is substantially perpendicular to fuel injectors 20 and preferably has a continuous peripheral groove 58 to receive a primary seal 50 and a secondary seal 52. The primary seal 50 seals between the shoulder 46 and the primary brim 32 of primary member 16; and the secondary seal 52 seals between the shoulder 46 and the secondary brim 38 of secondary member 18. An interposing seal 60 seals between the primary edge 34 and the secondary edge 36.

Figure 3:
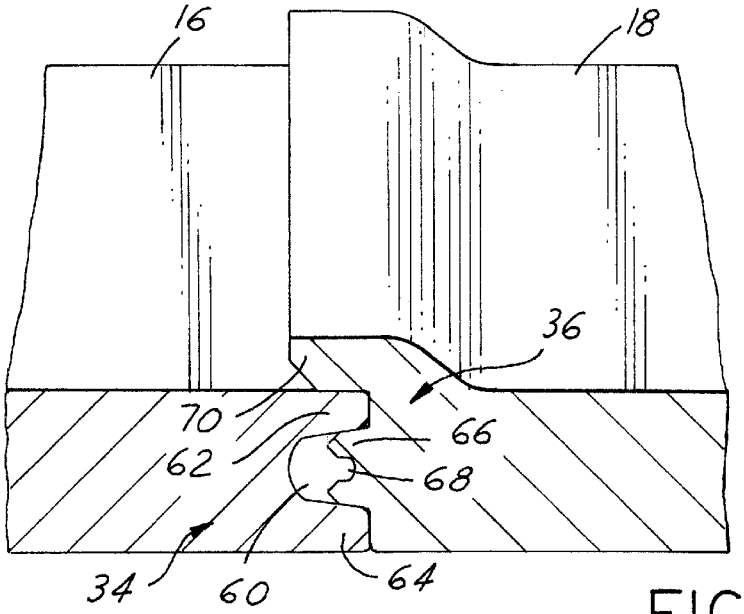
FIG. 3 is an enlarged cross-sectional view of a primary edge connected to a secondary edge.

Referring to FIG. 3, the primary edge 34 has an upper rib 62 and a lower rib 64. The ribs 62, 64 extend longitudinally along the primary edge 34 between the two primary ends 54. Disposed between ribs 62, 64 is the interposing seal 60. Secondary edge 36 has a nubbin 66 which extends longitudinally along the secondary edge 36 between the two secondary ends 56. Also extending longitudinally at the nubbin 66 apex is a channel 68. The interposing seal 60 seats between the ribs 62, 64 and within the channel 68 of nubbin 66. To add rigidity along the length of interposing seal 60, the secondary edge 36 has a raised longitudinally extending lip 70. Lip 70 is generally perpendicular to the fuel injectors 20. The bottom side of lip 70 engages the top side of upper rib 62 thereby providing rigidity support.

Figure 4:
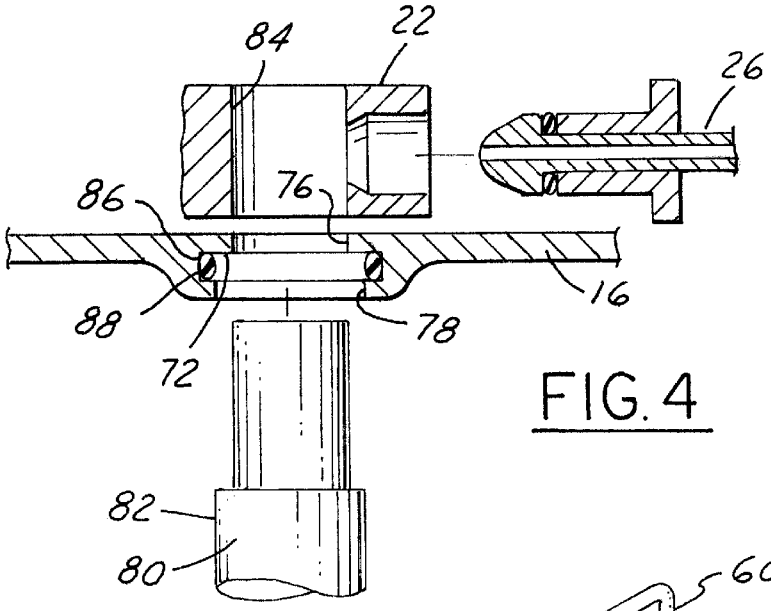
FIG. 4 is an enlarged cross-sectional exploded view of a fuel injector extending through an orifice of the primary member.

Referring to FIG. 4, each orifice 24 of the primary member 16 is circumscribed by an intermediate surface 72 generally facing downward. Contacting the intermediate surface 72 from below is a shelf 74 of the fuel injector 20. This contact provides longitudinal rigidity to the primary member 16 which assures sealant reliability of interposing seal 60 without the need for fasteners along the primary member 16 longitude. The intermediate surface 72 is substantially perpendicular to the fuel injector 20 longitude. Furthermore, intermediate surface 72 is disposed between and defined by an upper edge 76 and a lower edge 78. The intermediate surface 72, the upper edge 76, and the lower edge 78 circumvent and define the orifice 24 of primary member 16.

Attaching rigidly beneath the fuel feed end 22 of fuel injector 20 is an extension portion 80 which forms an upward facing shelf 74. The fuel feed end 22 periphery and the extension portion 80 periphery define the shape and area of shelf 74. The shelf 74 is substantially parallel to the intermediate surface 72. The cross sectional area of the fuel feed end 22 taken along the longitude of the fuel injector 20 is less than the cross sectional area of the extension portion 80 taken along the same longitude. The difference in cross sectional area amounts to the surface area of the shelf 74. This difference in area also enables placement of the primary member 16 over the pre-installed fuel injectors 20 during assembly.

Although the longitudinal contour of fuel feed end 22 and the extension portion 80 may be of any variety of shapes, the contour is preferably cylindrical. Furthermore, extension portion 80, the fuel feed end 22, intermediate surface 72, upper edge 76 and lower edge 78 are concentric. The orifice 24 is therefore circular, and the intermediate surface 72 and shelf 74 are annular. The upper edge 76 diameter is substantially less than the lower edge 78 diameter. Extension portion 80 further has an extension portion cylindrical wall 82 which opposes lower edge 78. Shelf 74 is disposed radially between and is defined by the extension portion cylindrical wall 82 and a fuel feed end cylindrical wall 84 which opposes upper edge 76. The fuel feed end and extension portion cylindrical walls 84, 82 are concentric to each other and generally perpendicular to the shelf 74.

Within lower edge 78 and in communication with orifice 24 is a peripheral groove 86 which seats a seal 88. Seal 88 preferable is an O-ring, which resiliently engages between the extension portion cylindrical wall 82 of injector 20 and the lower edge 78 of primary member 16.

Figure 5:
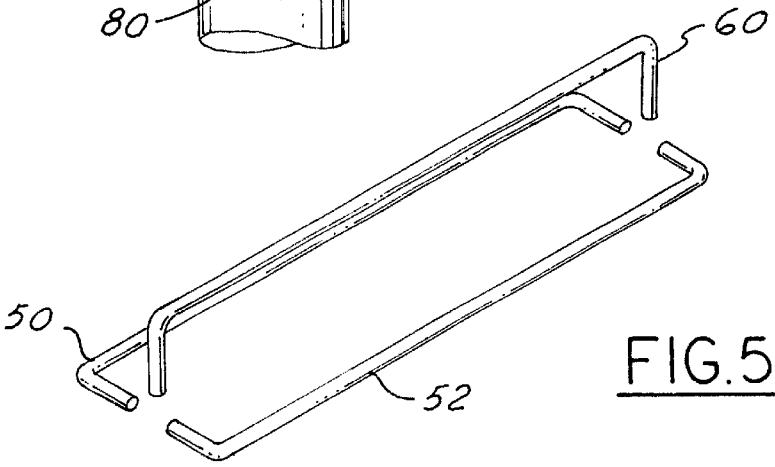
FIG. 5 is an exploded perspective view of a primary seal, a secondary seal, and an interposing seal.

Referring to FIG. 5, the primary seal 50 is generally planar to the secondary seal 52. The ends of interposing seal 60 are generally perpendicular to the primary and secondary seals 50, 52. The primary seal 50 and the secondary seal 52 can be molded as one unitary continuous seal. In the alternatives, the secondary seal 52 and the interposing seal 60 can be molded as one unitary continuous seal wherein the molded ends form right angles, or, all three seals 50, 52, 60 can be molded as one unitary seal wherein the molded ends form a T-joint.

Figure 6:
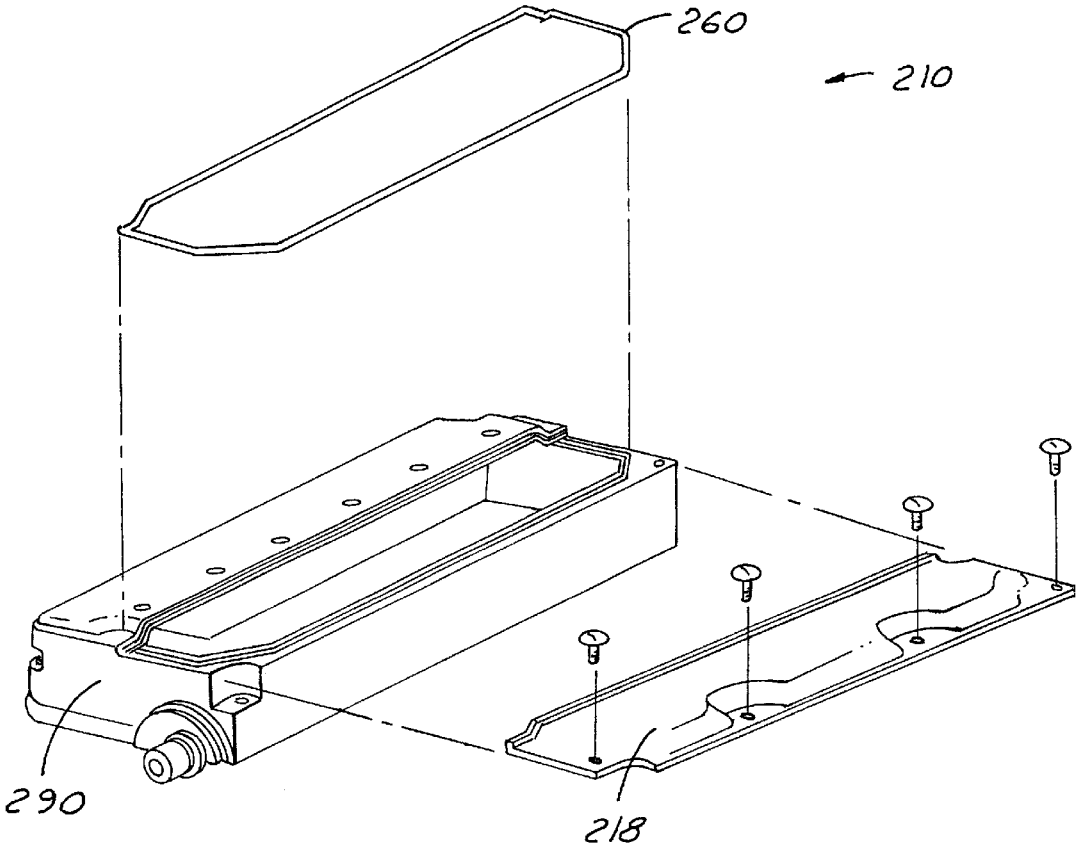
FIG. 6 is an exploded perspective view of a second embodiment of the sectionalized rocker arm cover assembly.

Referring to FIG. 6, a second embodiment is shown wherein the numeral two, "2," has been added as a prefix to like elements between the first and second embodiments. The primary member 16 is integral and unitary to the shoulder 46 of the first embodiment, thereby forming an alcove member 290. The alcove member 290 is beneficial in the sense that the primary and secondary seals 50, 52 are no longer required. In addition, the fasteners 49 which engage the primary member 16 to the shoulder 46 are no longer required. The secondary member 218, however, is still required along with the interposing seal 260. The interposing seal 260 is continuous and a plurality of fasteners 249 are required to hold secondary member 218 to the alcove member 290.

The shoulder 46, the primary member 16 and the secondary member 18 may be made of aluminum, steel, or plastic. For strength and weight considerations, larger diesel applications utilize aluminum. For smaller engine applications which utilize the second embodiment, injection molded plastic may be an ideal material for weight and ease of manufacturing considerations.

Although the preferred embodiments of the present invention have been disclosed, various changes and modifications may be made thereto by one skilled in the art without departing from the scope and spirit of the invention as set forth in the appended claims. It is also understood that the terms used herein are merely descriptive, rather than limiting, and that various changes in terminology may be made without departing from the scope and spirit of the invention.

What is claimed is:

1. A sectionalized rocker arm cover assembly comprising:

an elongated primary member having a primary brim, a primary edge, and a plurality of orifices, the primary brim having two primary ends, the primary edge spanning between the two primary ends, the orifices aligned longitudinally along the primary member, each orifice defined by an upper edge, a lower edge, and an intermediate surface, the upper edge disposed, axially above, and radially inward of the lower edge, the intermediate surface disposed between and defined by the upper and lower edges;

a secondary member having a secondary brim and a secondary edge, the secondary brim having two secondary ends, the secondary edge spanning between the secondary ends, the secondary edge sealingly engageable to the primary edge of the primary member, the first and second primary ends sealingly engageable to the respective first and second secondary ends;

a shoulder disposed beneath the primary and secondary members;

an edge seal disposed resiliently between the primary edge and the secondary edge, the primary edge having an upper rib and a lower rib, the upper and lower ribs extended longitudinally along the primary edge, the secondary member having a lip co-extending with the secondary edge, the lip engaging the upper rib, the upper rib disposed between the edge seal and the lip, the opposing sides of each rib defining a groove, the secondary edge having a nubbin extended longitudinally along the secondary edge, the nubbin having a channel extended longitudinally, the edge seal extended resiliently into the channel the nubbin inserted within the groove, the edge seal encapsulated resiliently between the primary edge and the nubbin within the groove;

a primary brim seal disposed resiliently between the primary brim and the shoulder; and a secondary brim seal disposed resiliently between the secondary brim and the shoulder.

2. A sectionalized rocker arm cover assembly attached to a cylinder head of a combustion engine, comprising:

an elongated primary member disposed above the cylinder head, the primary member having a primary brim and a primary edge, the primary brim connected to the cylinder head:

a plurality to fuel injectors each having a fuel feed end, the elongated primary member having a plurality of orifices, the orifices aligned longitudinally along the primary member, each orifice in receipt of a fuel injector, each fuel injector having said fuel feed end protruding upward through each respective orifice and an extension portion attached beneath the fuel feed end, the fuel feed end disposed radially inward of the extension portion, the extension portion having a shelf facing upward, the shelf disposed between and defined by the extension portion and fuel feed end peripheries; and each orifice of the primary member defined by an upper edge, a lower edge, and an intermediate surface, the upper edge disposed, axially above, and radially inward of the lower edge, the intermediate surface disposed between and defined by the upper and lower edges, the shelf engaged to the intermediate surface, the upper edge aligned axially and disposed radially outward of the fuel feed end, the lower edge aligned axially and disposed radially outward of the extension portion; and a second member having a secondary edge sealingly engageable to the primary edge of the primary member.

3. A sectionalized rocker arm cover assembly as set forth in claim 1, wherein the primary brim has two primary ends, the primary edge spanning between the two primary ends, and wherein the secondary member had a secondary brim having two secondary ends, the secondary edge spanning between the secondary ends.

4. A sectionalized rocker arm cover assembly as set forth in claim 3 further comprising:

an edge seal disposed resiliently between the primary edge and the secondary edge;

a primary brim seal disposed resiliently between the primary brim and the cylinder head; and a secondary brim seal disposed resiliently between the secondary brim and the cylinder head.

5. A sectionalized rocker arm cover assembly as set forth in claim 4 further comprising a plurality of fuel lines, each fuel line extended over the secondary member and connected to the fuel feed end of each respective fuel injector.

6. A sectionalized rocker arm cover assembly as set forth in claim 5 further comprising a shoulder disposed beneath and in resilient contact with the primary brim seal and the secondary brim seal, the cylinder head disposed beneath and engaged sealably to the shoulder.

7. A sectionalized rocker arm cover assembly as set forth in claim 6 wherein the first and second primary ends are sealingly engageable to the respective first and second secondary ends.

8. A sectionalized rocker arm cover assembly as set forth in claim 7 wherein the ends of the edge seal form to the respective ends of the primary brim seal forming one continuous primary seal.

9. A sectionalized rocker arm cover assembly as set fourth in claim 7 wherein the ends of the edge seal form to the respective ends of the secondary seal forming one continuous secondary seal.

10. A sectionalized rocker arm cover assembly as set forth in claim 7 wherein the ends of the edge seal, the ends of the primary seal, and the ends of the secondary seal respectively form together creating two respective T-joints and forming one continuous rocker arm cover seal.

11. A sectionalized rocker arm cover assembly as set forth in claim 10 wherein the primary edge has an upper rib and a lower rib, the upper and lower ribs extending longitudinally to the primary edge, the opposing sides of each rib defining a groove, the edge seal disposed within the groove.

12. A sectionalized rocker arm cover assembly as set forth in claim 11 wherein the secondary edge has a nubbin extending longitudinally along the secondary edge, the nubbin inserted within the groove, the edge seal encapsulated resiliently between the primary edge and the nubbin.

13. A sectionalized rocker arm cover assembly as set forth in claim 12 wherein the nubbin has a channel extending longitudinally, the edge seal extending resiliently into the channel.

14. A sectionalized rocker arm cover assembly as set forth in claim 13 wherein the secondary member has a lip co-extending with the secondary edge, the lip engaging the upper rib, the upper rib disposed between the edge seal and the lip.

15. A sectionalized rocker arm cover assembly as set forth in claim 6 wherein the primary member, the secondary member and the shoulder are made of a material selected from the group consisting of plastic, aluminum and steel.

16. A sectionalized rocker arm cover assembly as set forth in claim 14 wherein the extension portion has a cylindrical wall having a diameter, the fuel feed end has a cylindrical wall having a diameter, the extension portion concentric to the fuel feed end, the extension portion cylindrical wall diameter greater than the fuel feed end cylindrical wall diameter, the shelf and the intermediate surface are annular, the shelf defined by the extension portion cylindrical wall and the fuel feed end cylindrical wall.

17. A sectionalized rocker arm cover assembly for a combustion engine, comprising:

an elongated alcove member sealingly engageable to a cylinder head of the combustion engine, the cylinder head disposed below the alcove member, the alcove member having a plurality of orifices and a continuous primary edge, the orifices aligned longitudinally along the primary member;

a plurality of fuel injectors each having a fuel feed end, each fuel feed end protruding through each respective orifice from beneath the elongated alcove member; each fuel injector having a shelf and an extension portion attached concentrically beneath the fuel feed ends the extension portion having an extension portion cylindrical wall, the fuel feed end having a fuel feed end cylindrical wall, the extension portion cylindrical wall diameter greater than the fuel feed end cylindrical wall diameter, the extension portion and fuel feed end cylindrical walls defining a shelf; and each orifice of the primary member defined by an upper edge, a lower edge, and an intermediate surface, the upper edge disposed concentrically to, axially above and radially inward of the lower edge, the intermediate surface disposed radially between and defined by the upper and lower edges, the shelf contacting the intermediate surface; and a secondary member having a continuous secondary edge, the secondary edge sealingly engageable to the primary edge of the alcove member; and a plurality of fuel lines, each fuel line extended over the secondary member and connected to the fuel feed end of each respective fuel injector.

18. A sectionalized rocker arm cover assembly as set forth in claim 17, further comprising a continuous edge seal disposed resiliently between the primary edge and the secondary edge.

* * * * *